US006938380B2

(12) United States Patent
Friedman et al.

(10) Patent No.: US 6,938,380 B2
(45) Date of Patent: Sep. 6, 2005

(54) ELEVATOR ENTRANCE SILL STRUCTURE AND INSTALLATION METHOD

(75) Inventors: Harold S. Friedman, 7 Gracie Sq., Apt. 7A, New York, NY (US) 10028; Richard B. Michalik, Union City, NJ (US); George Karazim, Hicksville, NY (US); Jeffrey Friedman, New York, NY (US)

(73) Assignee: Harold S. Friedman, New York, NY (US)

( * ) Notice: Subject to any disclaimer, the term of this patent is extended or adjusted under 35 U.S.C. 154(b) by 165 days.

(21) Appl. No.: 10/233,277

(22) Filed: Sep. 3, 2002

(65) Prior Publication Data

US 2003/0111297 A1 Jun. 19, 2003

Related U.S. Application Data

(60) Provisional application No. 60/340,135, filed on Dec. 14, 2001.

(51) Int. Cl.[7] ..... B66B 9/00

(52) U.S. Cl. ..... 52/30; 52/211; 52/217; 49/505

(58) Field of Search ..... 52/30, 217, 211, 52/745.16; 49/468, 505; 187/313, 325, 326, 336

(56) References Cited

U.S. PATENT DOCUMENTS

| | | | | | |
|---|---|---|---|---|---|
| 3,601,938 | A | * | 8/1971 | Loomis | 52/29 |
| 3,686,808 | A | * | 8/1972 | Loomis | 52/211 |
| 3,735,539 | A | * | 5/1973 | Pfund | 52/98 |
| 3,740,907 | A | * | 6/1973 | Loomis | 52/205 |
| 3,948,358 | A | * | 4/1976 | Atkey | 187/408 |
| 3,984,952 | A | * | 10/1976 | Loomis | 52/127.1 |
| 4,781,270 | A | * | 11/1988 | Holland | 187/324 |
| 5,794,746 | A | * | 8/1998 | Ketonen et al. | 187/333 |
| 5,915,501 | A | * | 6/1999 | Lodi et al. | 187/333 |
| 6,202,798 | B1 | * | 3/2001 | Friedman et al. | 187/333 |

FOREIGN PATENT DOCUMENTS

| | | | | |
|---|---|---|---|---|
| JP | 54058929 | A * | 5/1979 | E06B/1/56 |
| JP | 02310287 | A * | 12/1990 | B66B/13/30 |
| JP | 05078073 | A * | 3/1993 | B66B/13/30 |
| JP | 08240010 | A * | 9/1996 | E04G/21/32 |

* cited by examiner

*Primary Examiner*—Brian E. Glessner

(57) ABSTRACT

This invention relates to a cost saving way of solving a difficult problem in the structure and installation and leveling of an elevator sill.

This invention provides ease of installing from the hallway without the use of a moving elevator platform. The structure consists of a sill, a cradle for the sill and a pair of end brackets for supporting the cradle.

The pair of spaced L-shaped end brackets are provided for attachment to the hall floor. A vertically adjustable sill cradle is supported at its end portions by the brackets and a horizontally and vertically adjustable sill is mounted on the sill cradle.

The elevator door sill cradle is adjustable vertically by means of fasteners that are moveable in vertical slots in the end brackets and is horizontally adjustable on the cradle by means of fasteners that are moveable in horizontal slots provided in the cradle.

5 Claims, 6 Drawing Sheets

ELEVATOR ENTRANCE SILL STRUCTURE AND INSTALLATION METHOD

This application claims the benefit of provisional application No. 60/340,135 filed on Dec. 14, 2001.

FIELD OF INVENTION

The present invention relates to building construction and more particularly to an advantageous elevator entrance sill structure and installation method that allows for complete installation from the hallway without the use of a moving elevator platform.

BACKGROUND OF INVENTION

A number of structures and methods are known and commonly used to install an Elevator Entrance Sill including the following:

"Sill Support Pocket". This method is typically used in a building where the structural method of support is poured concrete. The concrete hall floor slab extends into the shaft and a pocket approximately 2" to 3" deep must be created in the top edge of the slab inside the elevator shaft in the opening where the entrance is to be located. Making a pocket is a time consuming and costly procedure. The sill is fastened to this pocket by means of adjustable brackets and eventually the whole entrance is mounted on top of the sill. There are a number of common problems with this cumbersome and inefficient method:

a. When the floor is poured, the contractor forgets to build the pocket into the form used to shape the floor slab. The concrete must then be chopped out manually, a time consuming and inaccurate process b. The pocket is formed unevenly or inaccurately because the tolerances for pouring concrete are much larger than those in entrance installation. Installation now takes longer to adjust the entrance components and specially made parts may be required c. Because the sill adjustment angles leave a large empty space under the sill, cement must be poured under the sill in order to minimize deflection when a heavy load is run over the sill or from sagging over time due to traffic. If the sill is allowed to bend too much the doors can come out of their tracks and fall off the entrance, leaving an open shaft "Sill Support Angle". This method is typically used in a building where the structural method of support is steel. Since the floor slab does not extend into the shaft, L-shaped structural steel angles are bolted into the shaft wall a few inches below the floor at each opening. The sill is then mounted on this angle using adjustable brackets. The most significant disadvantage is that this can only be done from a running elevator platform (when the elevator's mechanical and electrical systems are installed and the cab enclosure has been placed in the shaft). This presents the following problems:

a. Using the running elevator platform for sill support angle installation prevents other trades from using it. The elevator construction company cannot make any adjustments on the elevator's performance, nor can the platform be used to bring other material up and down within the building b. When the platform is being used the elevator company cannot work below it in the shaft c. Trade union regulations require that only a qualified operator can operate the platform, but this operator cannot assist in installing the sill support angles, thereby adding extra cost to the entrance installation d. Because the sill adjustment angles leave a large empty space under the sill, cement must be poured under the sill in order to minimize deflection when a heavy load is run over the sill or from sagging over time due to traffic. If the sill is allowed to bend too much the doors can come out of their tracks and fall off the entrance, leaving an open shaft "Continuous Strut/Beckett System". This method of erection can be used in any type of building. Sections of struts, U-shaped channels, are spliced together to turn continuously the whole height of the shaft parallel to the elevator rails, one strut on either side of the entrance opening. The struts are bolted to the wall periodically to allow them to hold the entire weight of the entrance assembly. Just below the opening at each floor, a sill mounting channel is installed horizontally and fastened to each strut. The sill is then installed on this channel and adjusted to the correct height. The primary problem with this method is that the struts and the sill mounting channel can only be installed from inside the shaft. As mentioned in the "Sill Support Angle" description, this presents the following problems which increase expense and complexity:

a. Using the running elevator platform prevents other trades from using it. The elevator company cannot make any adjustments on the elevator's performance, nor can the platform be used to bring other material up and down within the building b. When the platform is being used the elevator company cannot work below it in the shaft c. Trade union regulations require that only a qualified operator can operate the platform, but this operator cannot assist in installing the continuous struts, thereby adding extra cost to the entrance installation Accordingly there has been a need for a simple, inexpensive structure and method of sill installation that overcomes the above disadvantages.

SUMMARY OF THE INVENTION

In accordance with the principles of the present invention, the shortcomings of the aforementioned construction of an elevator entrance door sill assembly and installation method have been overcome through a new and improved sill assembly and installation process.

The QuickSill "Elevator Entrance Sill Structure and Installation Method" is an alternative, Elevator Entrance sill support system. While advances in building construction methodology, and hi-tech products have dramatically decreased the time frame associated with erecting today's High-rise structures. Elevator entrance installation has been left behind the time. It is no secret that the elevator contractors cannot keep up with the pace of the building in today's market.

In brief, this advantageous sill structure includes the following:

Brackets: One Bracket is provided at each end of the sill, attached to the concrete slab with spiral concrete bolts attaching the system to the floor.

Cradle: The Cradle sits in-between the two brackets anchored to the floor. This Cradle bolts directly to the brackets, in slotted holes offering Both horizontal and vertical adjustability. Once properly positioned, Jack Bolts are installed at precise locations within the cradle.

Sill: The Sill is bolted to the cradle, in slotted holes further enhancing adjustability. The system is designed to accept all available sill materials, including a stainless steel sill.

This method and structure known by the trademark QUICKSILL has the following advantages:

1. It can be used whether a building is built using concrete or steel as the method of structural support
   a. The extra cost and imprecision of a sill support pocket in a concrete building is avoided
   b. The inconveniences of working from a running platform to mount a sill support angle in a steel building is avoided
2. The QUICKSILL assembly is so rigid that no grout is required underneath the sill to keep it from deflecting, whereby the doors could pop out. This saves an entire step in the building process
3. The QUICKSILL structure provides a sturdy "bottom" to an entrance assembly that will allow more components to be pre-assembled in the factory. This will speed up field installation and allow elevator construction companies to complete their work earlier
4. The complete elevator sill assembly can be installed from the hall for the first time. This provides:
   a. Faster progress for the installation of the rest of the elevator system
   b. Safety benefits as the elevator shaft can be enclosed more quickly
   c. Cost savings from not requiring a platform operator to install material from inside the shaft An elevator entrance consists of many components, a frame, one or more doors, a sill, a header, two struts and miscellaneous mounting brackets which combined can weigh more than 400 pounds. In order to allow the door to slide, the elevator entrance has to be mounted inside the shaft—clear of the wall that divides the shaft from the hallway where people wait for the elevator.

The present invention provides a three piece assembly that supports all the entrance components and is the first item installed in the process of entrance erection. The three assembly pieces, a sill, a pair of end brackets and the support cradle which extends between the brackets, may be shipped assembled from the factory with the adjustment hardware hand-tightened. Standing in the hallway, the installers locate this sill assembly in the center of the entrance opening and then place the assembly on the edge of the elevator shaft so the cradle is suspended between the ends by the brackets inside the shaft. The concrete is drilled, cement anchors are put in the holes, and flat-head screw sleeves are used to fasten the assembly to the hallway floor. Then, if the sill has not been installed in the factory, it is mounted on the cradle. The sill is leveled and positioned properly and the adjustment hardware is machine tightened to lock it in place. The adjustment process includes screws tightened against the side of the slab to minimize rotation and screws tightened underneath the cradle to keep it from slipping. Once all adjustment is complete further entrance installation may proceed.

Elevator entrances must be aligned very carefully to the rails and no part of the entrance is more critical than the sill. The elevator door sill assembly of the present invention provides structures with a variety of slots and hardware to allow the sill to be adjusted in all planes with a very wide range of motion. Extension brackets can also be easily added to expand the range of motion without adverse effect on the structural strength. This elevator sill assembly and installation method incorporates a design feature to facilitate the work of other trades as they relate to the entrance. Slots punched in the edge that sits atop the floor slab allow carpenters to easily fasten drywall track to the floor if the entrance is being installed in a sheetrock wall.

This invention relates to a highly advantageous, novel and cost saving way of solving a difficult and expensive problem in the structure and installation and leveling of an elevator sill. The assembly structure and installation is one of simplicity and ease of installing from the hallway. The structure consists of only three major components, a sill, a cradle for the sill and a pair of brackets for supporting the cradle and sill from the hall floor.

The elevator door sill assembly is installable from a hallway without the use of a moving elevator platform. A pair of spaced generally L-shaped end brackets are provided for attachment to the hall floor of an elevator entrance. A vertically adjustable sill cradle is supported at its end portions by the brackets and a horizontally and vertically adjustable sill is mounted on the sill cradle. Adjustment means are provided on the brackets which allow the cradle to be leveled and to be adjusted so that the cradle level conforms to the hall floor.

The elevator door sill cradle is adjustable vertically by means of fasteners that are moveable in vertical slots in the end brackets. The elevator door sill is horizontally adjustable on the cradle by means of fasteners that are moveable in horizontal slots provided in the cradle. The elevator door sill assembly brackets are L-shaped with a vertical cleat extending therefrom toward the interior of the elevator shaft. The cleats have vertical slots formed therein. The elevator door sill assembly has off set clips that are mounted on the sill and are attached to the lower ends of a pair of elevator door vertical posts. The elevator door sill assembly has the pair of vertical elevator door supports on opposite sides of the pair of vertical elevator door posts which are adjustably attached to the brackets.

The method of installing an elevator door sill assembly without using a moving elevator platform in which the assembly is installed from the hallway and viewed from the hallway has the following steps:

a. The hall floor adjacent to the elevator shaft door entrance is prepared by the placement of anchors therein to position and fasten a pair of spaced support brackets,
b. Support brackets are fastened to the flat horizontal floor of the hall by the anchors and spaced apart so as to support opposite ends of a sill,
c. a vertically adjustable sill cradle is attached at opposite ends to the support brackets,
d. a sill is attached to the top side of the cradle,
e. the cradle is vertically adjusted relative to the brackets so that the sill is leveled with the hall floor,
f. the sill is horizontally moved by means of adjustable fasteners so that the sill is properly placed between the elevator hall and the elevator floor.

The brackets are provided with vertical slots and cradle fasteners are moved up and down vertically to level the carriage and sill. The cradle is provided with horizontal slots for sill fasteners and horizontally adjusting the sill by adjusting the sill fasteners so that the slide is properly aligned between the elevator hall and the elevator floor.

Accordingly the advantages of the Elevator Entrance Sill Structure and Installation Method include:

1. Ability to adapt to changing field conditions Attachment to floor offers a more consistent surface than shaft walls, thus eliminating chopping to facilitate proper wall bracket placement.

2. Does not require moving platform for installation. Should the elevator be shut down, work can continue on entrance installation while repairs are in progress. Enables multitasking or second shift entrance installation without affecting ongoing car top operations.
3. Mounts from hall side as well as shaftway. Versatility is what this system is based on.
4. Increased horizontal and vertical adjustability of sill. Easily adjustable both in and out and up and down, via adjustment hardware. No relocating of attachment brackets.
5. Groutless from inside the shaft. QuickSill is easily grouted in from the hall side of the entrance. The supplied Grout Stop presses into place, and rests on jack bolts, creating a pocket that is filled by approximately 10 pounds of concrete mix.
6. Unaffected by poor shaftway wall construction. Deviations to shaft walls no longer require costly chopping at bracket location points.
7. Enables multitasking within single shaft. With proper protection, car frame can be positioned as to facilitate installation of cab or other work concurrently with entrance installation.

DETAILED DESCRIPTION OF THE INVENTION

Figure 1:
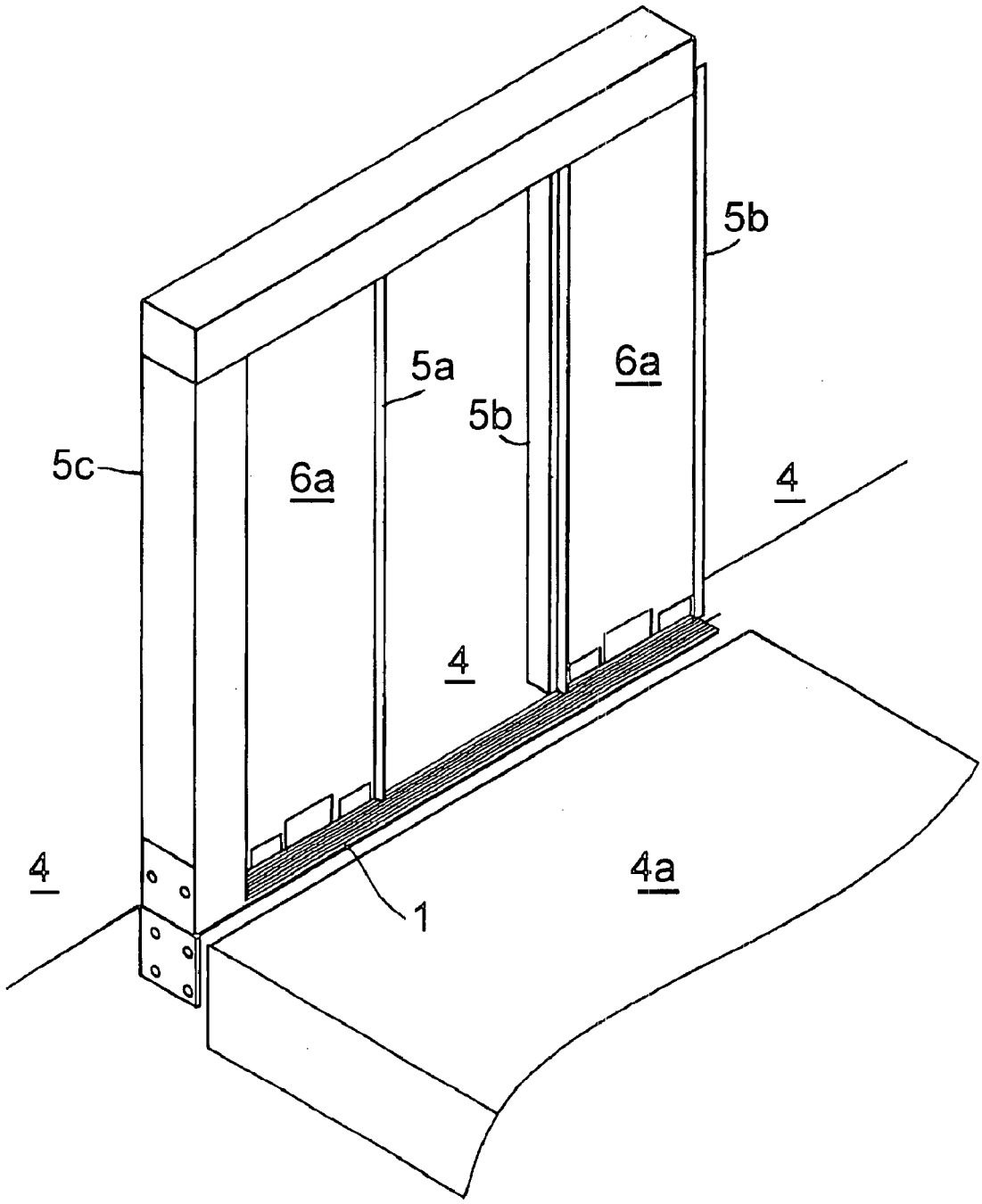
FIG. 1 is a partial perspective view of the elevator entrance from the inside of the elevator with the doors open to the hall.
Figure 2:
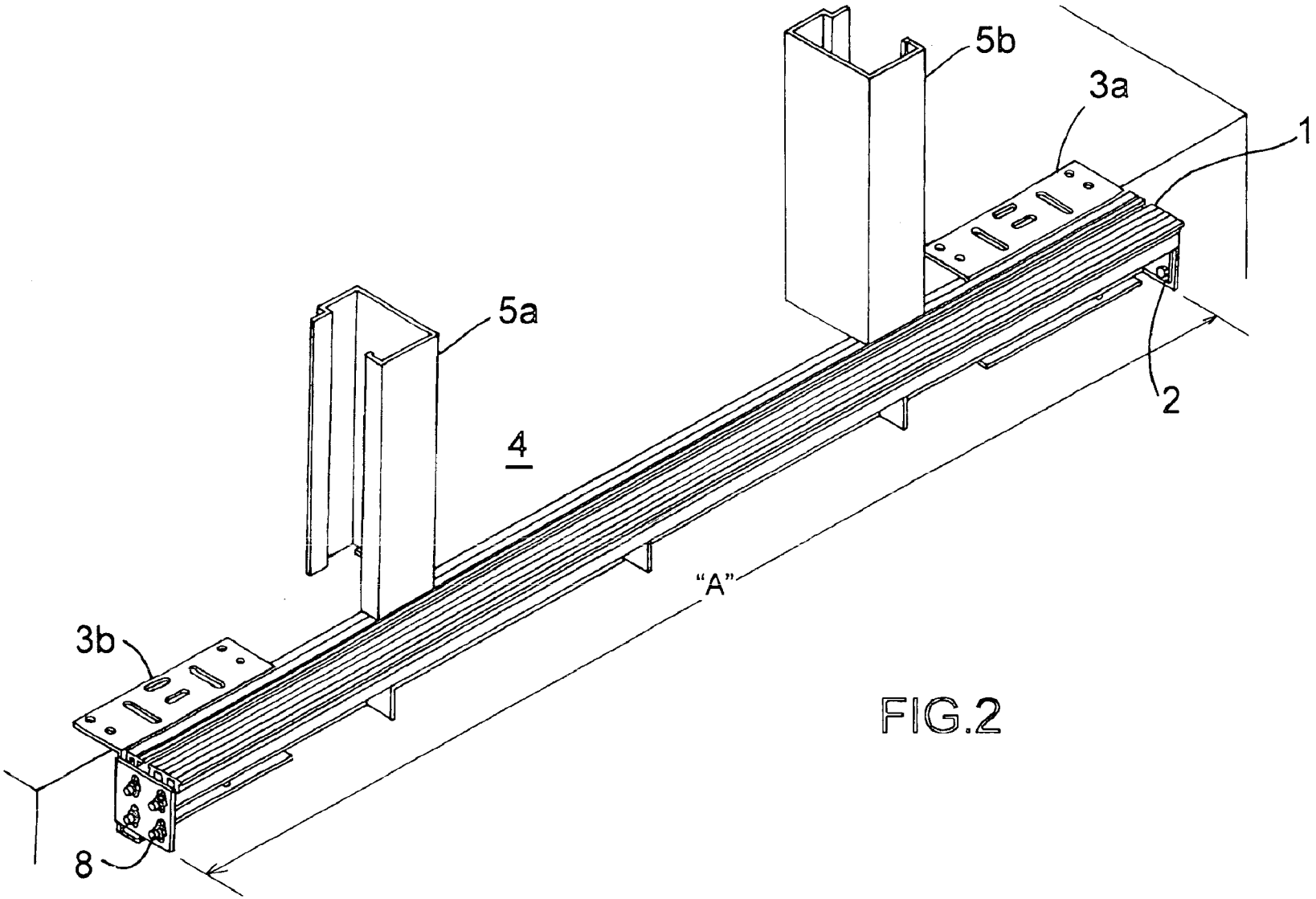
FIG. 2 is a perspective view of the elevator door sill assembly of the present invention.
Figure 3:
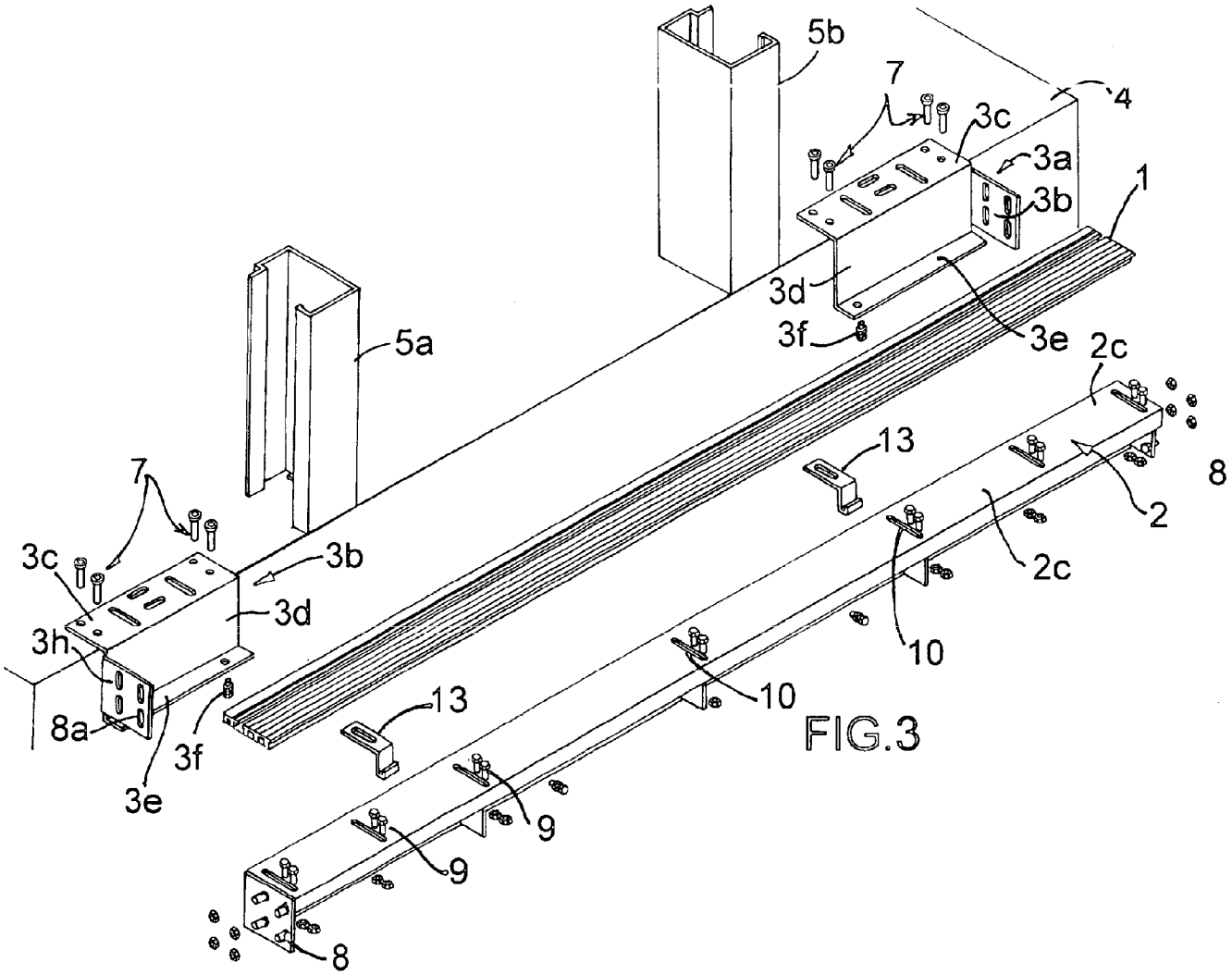
FIG. 3 is an expanded perspective view of elevator door sill assembly of FIG. 2.

The elevator door entrance sill assembly of the present invention is attached to the building hall floor 4 forming the elevator door opening. As illustrated in FIGS. 1, 2 and 3, the sill assembly includes a sill 1 mounted on a support cradle 2. The sill is for a sliding elevator door that rides in a track in the sill. At opposite ends, the cradle 2 is supported and attached to the building floor by shaped end adjustable support brackets 3*a* and 3*b* which provide shoe like support for the cradle 2. The adjustable support brackets 3*a* and 3*b* are mounted on the building floor 4 at either side of the elevator vertical door frames 5*a* and 5*b*. Outer vertical supports 5*c* and 5*d* form the structure for the elevator entrance as shown in FIG. 1. The sliding elevator doors 6 are in open position to provide access from the elevator floor area 4*a* to the building hall floor 4.

Figure 4:
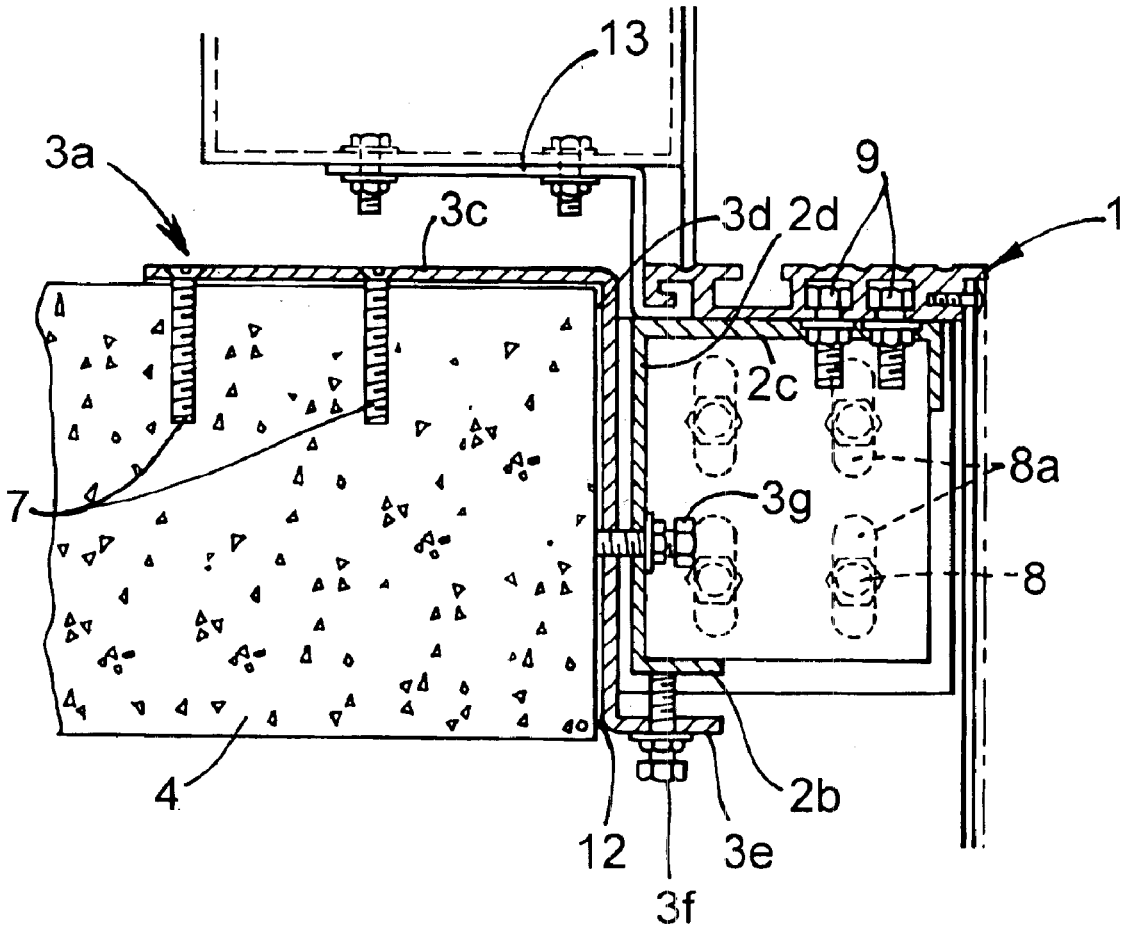
FIG. 4 is a cross-sectional view of the hall floor, the support brackets, sill and sill cradle at one end of the assembly.

As illustrated in FIGS. 2, 3 and 4, the sill cradle 2 is bolted at opposite ends to the brackets 3*a* and 3*b* by means of adjustable cradle fastener bolts 8 which allow for up and down vertical adjustment of the cradle 2 and sill 1 for leveling the sill. The adjustable movement is provided for by the vertical slots 8*a* provided in the shoulder portion 3*h* of the brackets 3*a* and 3*b*. The sill 1 is in turn bolted to the top of the cradle with adjustable fastener bolts 9. The cradle 2 is provided with multiple slots 10 to allow horizontal adjustment of the sill 1 and the cradle 2 relative to the building floor 4 and the elevator floor 4*a*.

Figure 5A:
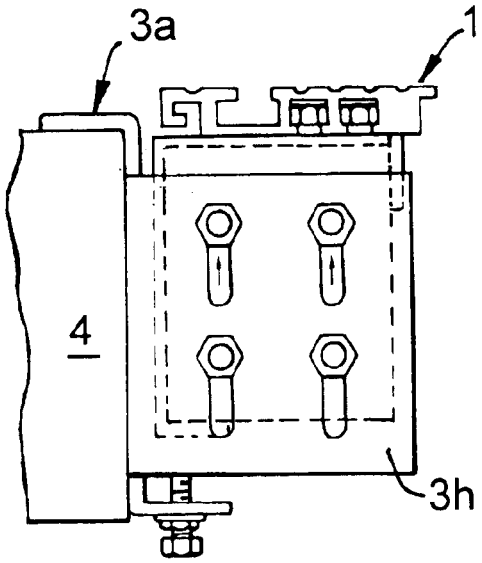
FIG. 5*a* is an end view of the support bracket illustrating an upward adjustment in the position of the cradle and sill.
Figure 5B:
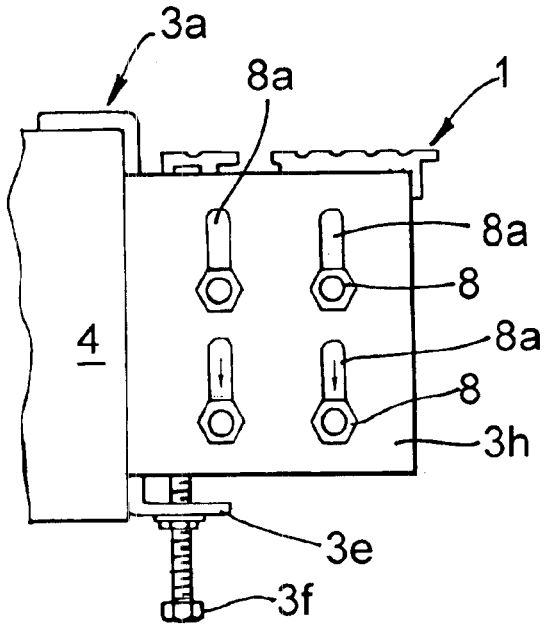
FIG. 5*b* is an end view of the opposite bracket on the other end of the assembly illustrating a downward adjustment of the cradle and sill.

As illustrated in FIGS. 4 and 5*a* and 5*b*, the horizontal level of the sill 1 can be adjusted so that it properly levels with the building hall floor 4 by means of adjustable bolts 8 on the brackets 3*a* and 3*b*. As illustrated, the sill 1 and cradle bolt 9 can be adjusted to move the sill up or down in the vertical slots 10.

In the cross-section of FIG. 4 the sill assembly is illustrated with adjustable bracket 3*a* bolted into the concrete floor 4 with sleeve anchors 7. The advantageous structure of the end brackets 3*a* and 3*b* is illustrated in FIGS. 3 and 4. The brackets 3*a* and 3*b* have a horizontal portion 3*c* bolted to the hall floor 4 by anchors 7. A vertical portion 3*d* of the L-shaped brackets 3 extends downward along the inside face of the elevator shaft wall 12. The brackets 3 have a horizontal ledge portion 3*e* which extends from the lower edge of the vertical portion 3*d* to provide support for the sill cradle 2. An adjustable threaded screw 3*f* is provided for vertical adjustment of the cradle 2 in cooperation with the adjustable bolts 8 and complementary slots 8*a* provided on the brackets 3*a* and 3*b*. An additional bolt 3*g* may be provided to also give support to the cradle 2 by attaching the cradle vertical portion 2*b* to the vertical bracket portion 3*d*. These cradle bolts 3*g* are placed after the vertical adjustment of the cradle 2 has been completed.

The cradle 2 illustrated in FIGS. 3 and 4 is also generally L-shaped with vertical portion 2*b* and horizontal portion 2*c*. Bolts 9 connect the sill 1 to the cradle 2 through adjustment horizontal slots 10 in the horizontal portion 2*c* which allow the sill to be adjusted horizontally relative to the hall floor 4 and the elevator floor 4*a*.

Figure 6A:
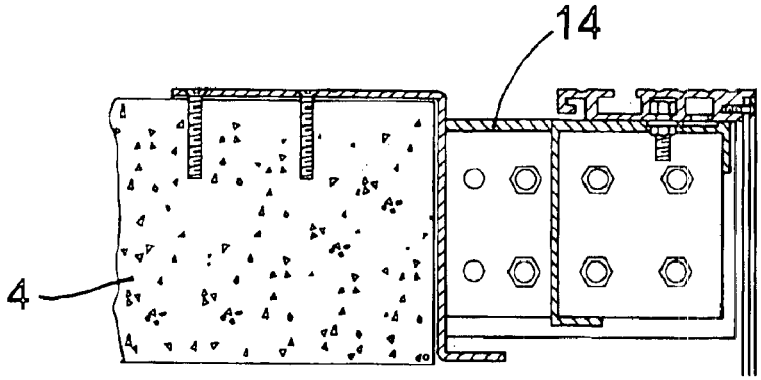
FIG. 6*a* is a cross-sectional view of a bracket with an extension plate in place.
Figure 6B:
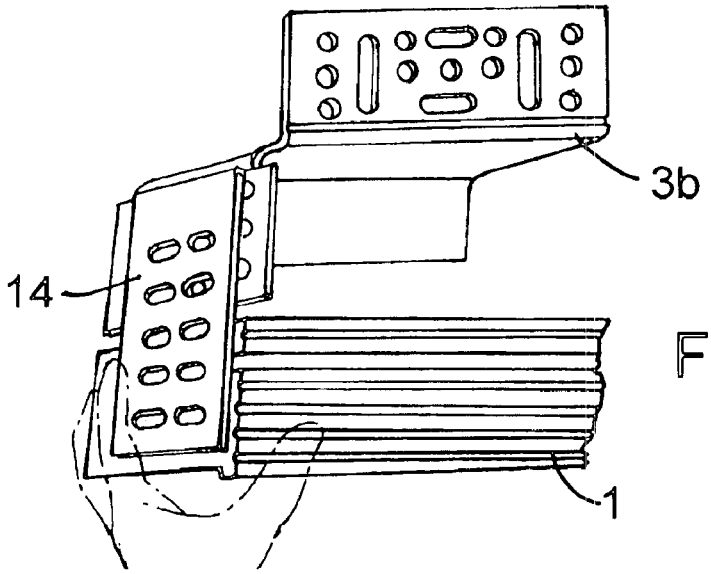
FIG. 6*b* is a top view of a bracket with an extension plate.
Figure 6C:
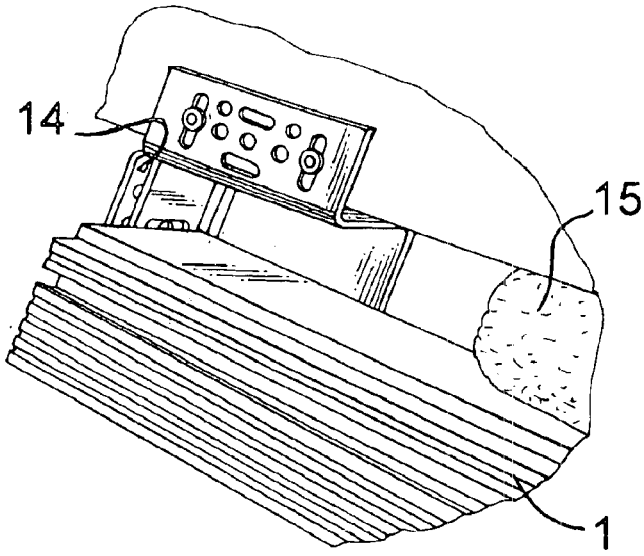
FIG. 6*c* is a top view of a bracket with an extension plate being installed.

As disclosed in FIGS. 6*a*, 6*b* and 6*c*, horizontal extension plates 14 may be used to extend the sill into the elevator shaft away from the building floor slab 4. The elevator plates have holes to receive appropriate bolts to attach the plates 14 to the brackets 3*a* and 3*b* and to opposite ends of the support cradle 2. In effect the plates 14 are extensions of the shoulder portions 3*h* of the brackets 3*a* and 3*b*.

As shown in FIG. 6*c*, grout 15 may be placed between the slab 4 and the cradle 2.

METHOD OF INSTALLATION

The advantageous elevator door sill assembly allows for complete erection from the hall side of the entrance. This provides the great advantage that the elevator platform does not need to be used for this method of assembly.

The steps of assembly from the hall area adjacent to the elevator shaft include:

1. Establish the location on the hall floor slab edge to set the location of the support brackets.
2. Place brackets 3*a* and 3*b* at slab edge 4 at locations established in step 1.
3. Drill the concrete slab 4 and secure brackets 3*a* and 3*b* to the slab 4 with concrete spiral bolts 7 or anchors.
4. Mount the cradle 2 to brackets 3*a* and 3*b* and snug the cradle bolts 8.
5. Slide the offset clips 13 into sill 1 for future frame attachment.

6. Mount the sill 1 to the cradle 2 through the slotted holes 10 and snug bolts 9.

7. Adjust complete assembly horizontally and vertically to predetermined benchmarks and set jack bolts 3*g* to meet slab edge 4.

8. Check all dimensions for accuracy and properly tighten all fasteners.

9. Place the group stop 12 between the slab edge 4 and the cradle 2 resting on the jack bolts 3*f*.

The sill is now properly set and ready for frame installation.

This use of two components, a sill 1 and cradle 2 with generally L-shaped cross section provide a simple and highly advantageous structure easily supported by end brackets 3*a* and 3*b* so that this assembly can be constructed from the hall adjacent the elevator shaft.

We claim:

1. An elevator door sill assembly installable from a hallway without the use of a moving elevator platform in a vertically extending elevator shaft comprising a pair of spaced end brackets for attachment to the hall floor of an elevator entrance, a vertically adjustable sill cradle supported at its end portions by said brackets, a horizontally and vertically adjustable sill mounted on said sill cradle, adjustment means on said brackets allowing said cradle to be leveled and to be adjusted so that the cradle level conforms to the hall floor and wherein the said brackets are shaped to receive opposite ends of said cradle and said sill cradle is adjustable vertically by means of fasteners that are moveable in vertical slots in said end brackets and where said sill is horizontally adjustable on said cradle by means of fasteners that are moveable in horizontal slots provided in said cradle and wherein said brackets have vertical shoulder portions extending therefrom toward the interior of the elevator shaft, said shoulders having said vertical slots formed therein.

2. The elevator door sill assembly of claim 1, wherein off set clips are mounted on said sill and are attached to the lower ends of a pair of elevator door vertical posts.

3. The elevator door sill assembly of claim 2 wherein a pair of vertical elevator door supports on opposite sides of said pair of vertical elevator door posts are attached to said brackets.

4. An elevator sill assembly installable from a hallway without the use of a moving elevator platform in a vertically extending elevator shaft comprising:

a pair of spaced end brackets for attachment to the hall floor of an elevator entrance, said end brackets being complementary shaped to receive opposite ends of a sill cradle, said cradle being vertically adjustable at its end portions on said brackets, a horizontally and vertically adjustable sill mounted on said sill cradle, said cradle being adjustable vertically by means of fasteners moveable in vertical slots in said end brackets allowing said cradle to be leveled and to be adjusted so that the cradle and sill level conforms to the hall floor, and where said sill is horizontally adjustable on said cradle by means of fasteners that are moveable in slots provided in said cradle, and wherein said end brackets are L-shaped and have a vertical cleat extending therefrom toward the interior of the elevator shaft, said cleat having said vertical slots formed therein to receive said fasteners.

5. The elevator door sill assembly of claim 4 wherein off set clips are mounted on said sill and are attached to the lower ends of the elevator door vertical posts and wherein the up-right vertical elevator door supports are attached to said end brackets.

* * * * *